US011553799B2

(12) United States Patent
Signarsson et al.

(10) Patent No.: US 11,553,799 B2
(45) Date of Patent: Jan. 17, 2023

(54) ERGONOMIC CHAIR

(71) Applicant: Native Bionics Scandinavia AB, Stockholm (SE)

(72) Inventors: Mikael Signarsson, Upplands Vasby (SE); Martin Bolter, Akersberga (SE); Martin Kramberg, Upplands Vasby (SE); Izabela Cierlik, Stockholm (SE)

(73) Assignee: Native Bionics Scandinavia AB, Stockholm (SE)

( * ) Notice: Subject to any disclaimer, the term of this patent is extended or adjusted under 35 U.S.C. 154(b) by 0 days.

(21) Appl. No.: 17/756,257

(22) PCT Filed: Nov. 20, 2020

(86) PCT No.: PCT/SE2020/051109
§ 371 (c)(1),
(2) Date: May 20, 2022

(87) PCT Pub. No.: WO2021/101434
PCT Pub. Date: May 27, 2021

(65) Prior Publication Data

US 2022/0346554 A1 Nov. 3, 2022

(30) Foreign Application Priority Data

Nov. 22, 2019 (SE) ..... 1900200-5

(51) Int. Cl.
*A47C 9/00* (2006.01)
*A47C 7/50* (2006.01)
(Continued)

(52) U.S. Cl.
CPC ..... *A47C 9/005* (2013.01); *A47C 7/02* (2013.01); *A47C 7/402* (2013.01); *A47C 7/50* (2013.01)

(58) Field of Classification Search
CPC ..... A47C 9/005; A47C 7/02; A47C 7/402; A47C 7/50
See application file for complete search history.

(56) References Cited

U.S. PATENT DOCUMENTS 4,832,407 A 5/1989 Serber
4,943,117 A 7/1990 Brown
(Continued)

FOREIGN PATENT DOCUMENTS

WO 8606940 A1 12/1986
WO 2011003215 A2 1/2011
(Continued)

OTHER PUBLICATIONS

International Search Report & Written Opinion, dated Dec. 18, 2020, Swedish Intellectual Property Office, Stockholm, Sweden.

*Primary Examiner* — Anthony D Barfield
(74) *Attorney, Agent, or Firm* — Noréns Patentbyrå AB

(57) ABSTRACT

An ergonomic chair (300) comprising a seat (310), a lower leg support (320), a chest support (330), and a hip support (360);

Figure 1A:
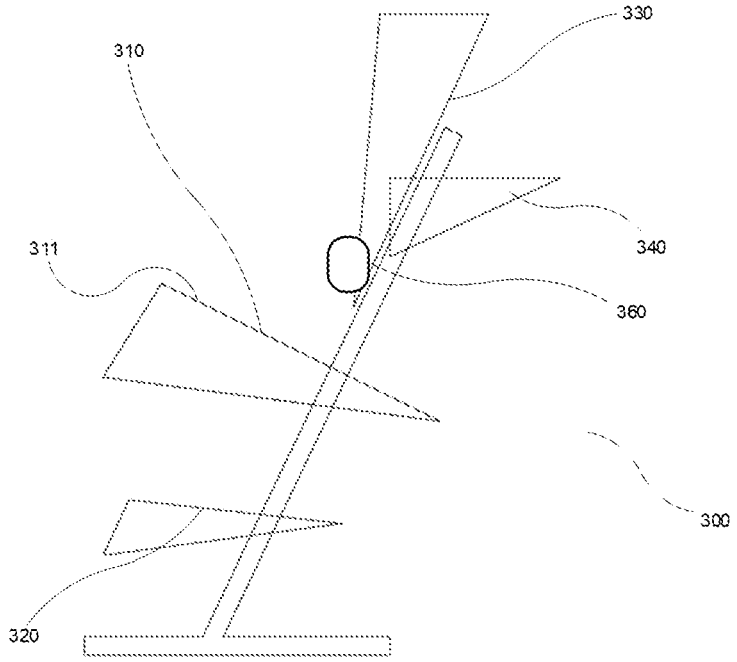

the seat (310) for supporting the posterior thigh (11) and/or buttocks (12) of a seated user (10), the seat (310) being configured to urge the hip of a seated user (10) in a forward direction;

the lower leg support (320) for supporting the anterior side of the lower legs (14) of the seated user (10);

the chest support (330) for supporting the chest (15) of the seated user (10) in a forward leaning position of the seated user (10);

the hip support (360) is configured to support the anterior hip of a seated user (10) as the seat (310) urges the seated user's (10) hip forwardly towards the hip support (360).

19 Claims, 7 Drawing Sheets

(51) Int. Cl.
*A47C 7/02* (2006.01)
*A47C 7/40* (2006.01)

(56) References Cited

U.S. PATENT DOCUMENTS

| | | | | |
|---|---|---|---|---|
| 10,918,213 | B2 * | 2/2021 | Fryer | A47C 9/002 |
| 2003/0090131 | A1 | 5/2003 | Roleder et al. | |
| 2007/0052275 | A1 | 3/2007 | Ghilzai | |

FOREIGN PATENT DOCUMENTS

| | | | | |
|---|---|---|---|---|
| WO | WO-2012114332 | A1 * | 8/2012 | A47C 9/005 |
| WO | 2018172830 | A1 | 9/2018 | |
| WO | WO-2020142240 | A1 * | 7/2020 | A47C 9/005 |

* cited by examiner

ERGONOMIC CHAIR

The present invention relates to an ergonomic chair. More particularly, the present invention relates to an ergonomic chair for use when performing work, a gaming activity, a creative activity, or in any other circumstance when using some type of stationary equipment or device. For instance, the present chair is useful as a gaming chair, an office chair or an artist's chair. The present invention is particularly useful for computer use, and in particular in combination with a screen display which is viewed by a user of the chair.

In the following, the present invention and its advantages will be described in the context of such computer use. However, it is noted that the invention finds equal utility in corresponding fields of use, such as for general office work, writing, handicraft work or in simulators of different types.

It is well-known that prolonged sitting in ergonomically non-optimal positions can potentially lead to physical injury. In particular, the neck is exposed to such injury, for instance as a result of the head of a sitting person being bent forward and downward, in turn leading to muscle tension and related issues.

There have been numerous proposals for ergonomic chairs. For instance, conventional office chairs come with a multitude of configuration possibilities, regarding seat height and angle, back support, suspension, and so forth. There are ergonomic chairs with an imbalance which is built-in on purpose, such as having only one leg or being supported on a nonstable foundation forcing the user to actively use core muscles to continuously balance the sitting position. There are ergonomic chairs with no back rest, forcing the user to assume a correct upright position when sitting. There are even ergonomic chairs featuring a chest support instead of a back support, allowing the user to lean forward rather than backward.

However, there are still problems with conventional ergonomic chairs. Many times, they are perceived as not comfortable enough for prolonged use, leading to users not continuing to use them. Also, they are often unable to provide the ergonomic benefits they are supposed to, either because the sitting position in practise will be less than optimal despite its good intentions or because users don't use them as intended.

Another problem with conventional ergonomic chairs is that they do not always encourage an "offensive" or "active" sitting position. A laidback, "passive" or "inactive", sitting position, or one in which the user is required to keep a certain non-desired muscle tension, will in general not provide an optimal user cognitive experience. When assuming a correct, forward-leaning and "active" sitting position, the sitting user will feel more active. It is even so that such "offensive" sitting positions will potentially lead to improved reaction times and a more active cognitive engagement with the task performed. This is in particular important for gaming, when the small margins encountered in many situations may make this the difference between winning and losing.

The present invention solves the above described problems, providing an ergonomic chair an ergonomically correct yet offensive sitting position. The chair of the invention can also be manufactured in an efficient way from standard materials and be aesthetically appealing.

Hence, the invention relates to an ergonomic chair comprising a seat, a lower leg support, a chest support, and a hip support;

the seat for supporting the posterior thigh and/or buttocks of a seated user, the seat being configured to urge the hip of a seated user in a forward direction;

the lower leg support for supporting the anterior side of the lower legs of the seated user;

the chest support for supporting the chest of the seated user in a forward leaning position of the seated user; and the hip support is configured to support the anterior hip of a seated user as the seat urges the seated user's hip forwardly towards the hip support.

The invention is characterised in that the seat has an area in the forward end of the seat that has a softer cushioning than the rest of the seat in order to provide less pressure to the private parts of a male user of the seat, or the seat has a recess at the forward end in order to provide less pressure to the private parts of a male user of the seat.

The seat can thereby be arranged to support the posterior thigh and/or buttocks of a seated user such that the femur bone of the seated user is downwards inclined in the anterior direction at an angle of 40-75° in relation to the horizontal, and the lower leg support is arranged to support the anterior side of the lower legs of the seated user, and the chest support is arranged to support the chest of the seated user in a forward leaning position of the seated, and the hip support secures the position of the user such that the third lumbar vertebrae body of the seated user is arranged in a support plane, which support plane is perpendicular to the sagittal plane of the user and in which support plane the respective pivot point of the seated user's hip joints and the respective pivot point of the seated user's shoulder joints are also arranged when the posture of the seated user is symmetric about the seated user's sagittal plane.

Figure 1B:
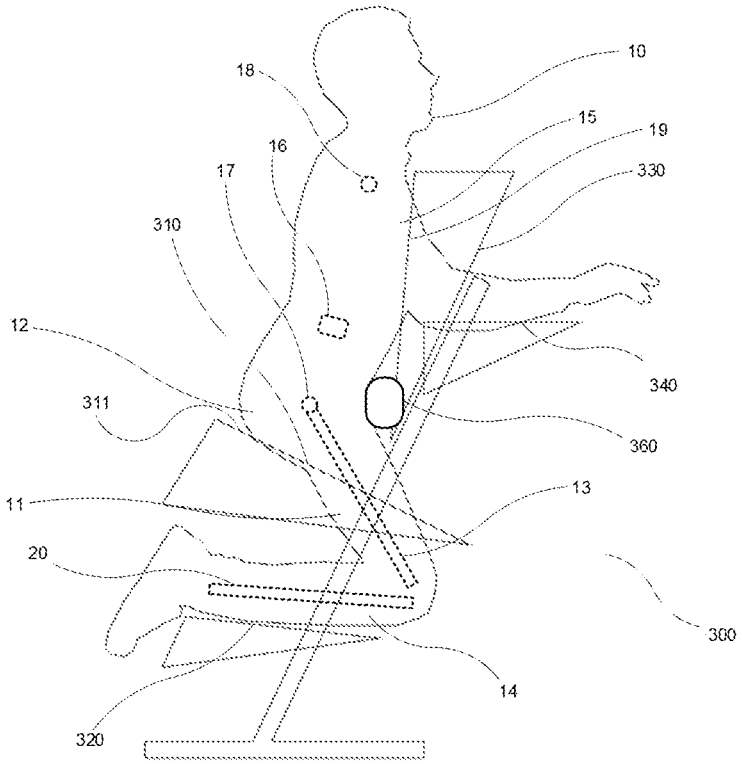
Figure 1C:
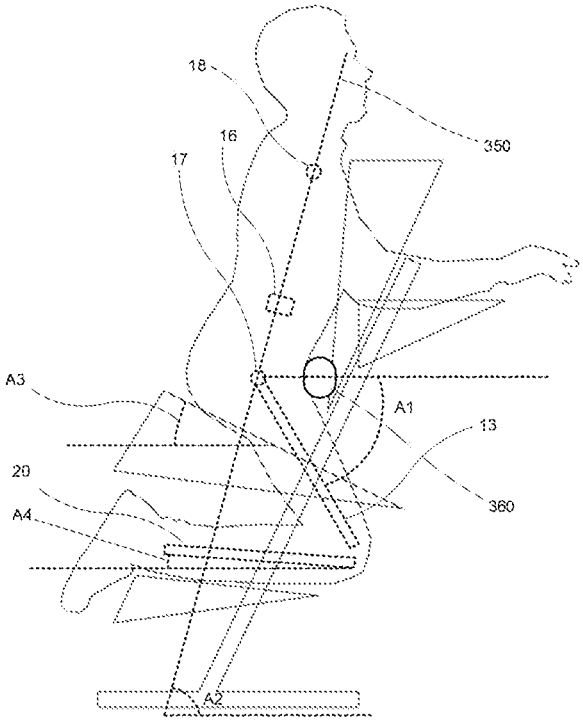
Figure 2A:
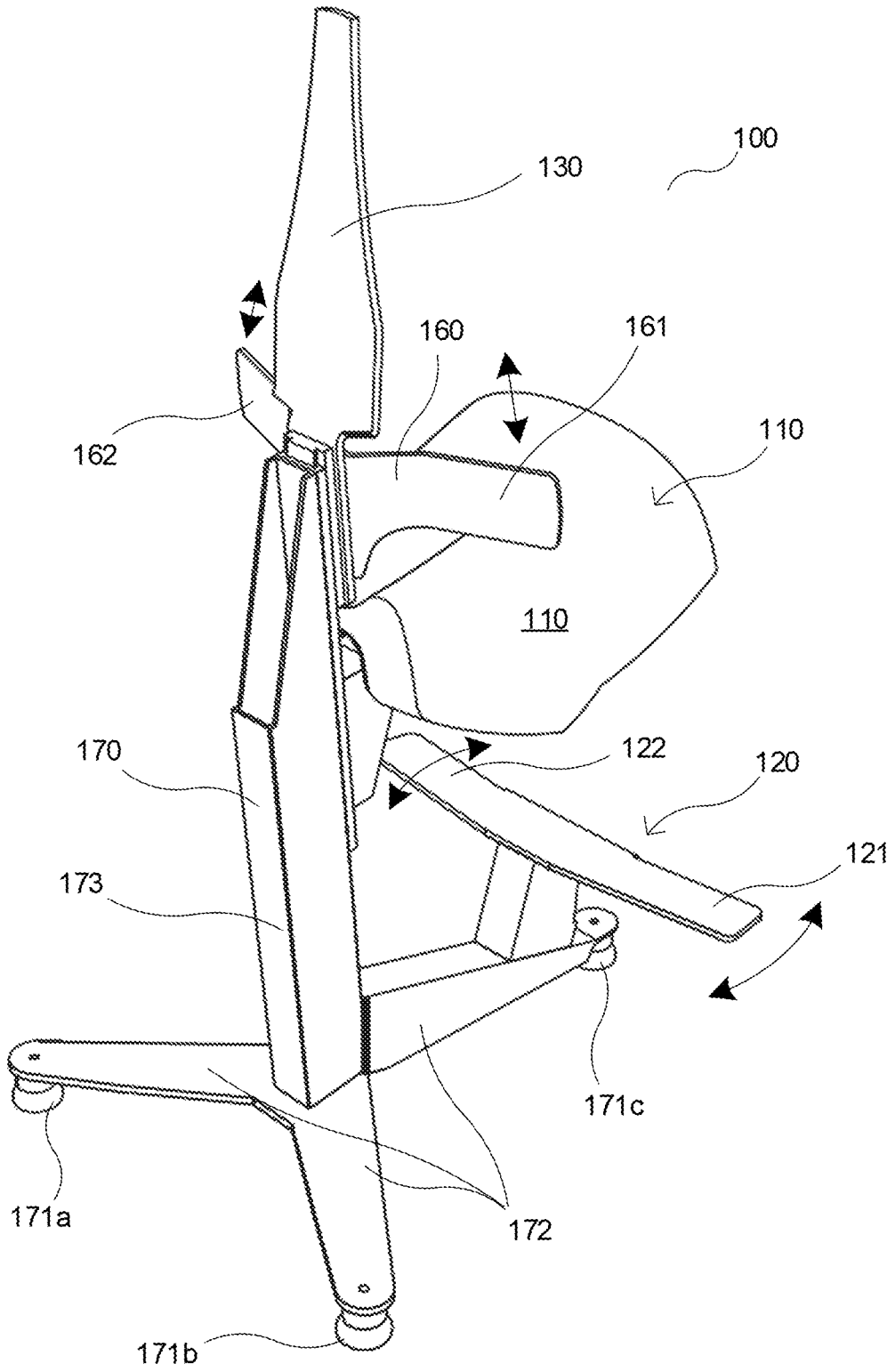
Figure 2B:
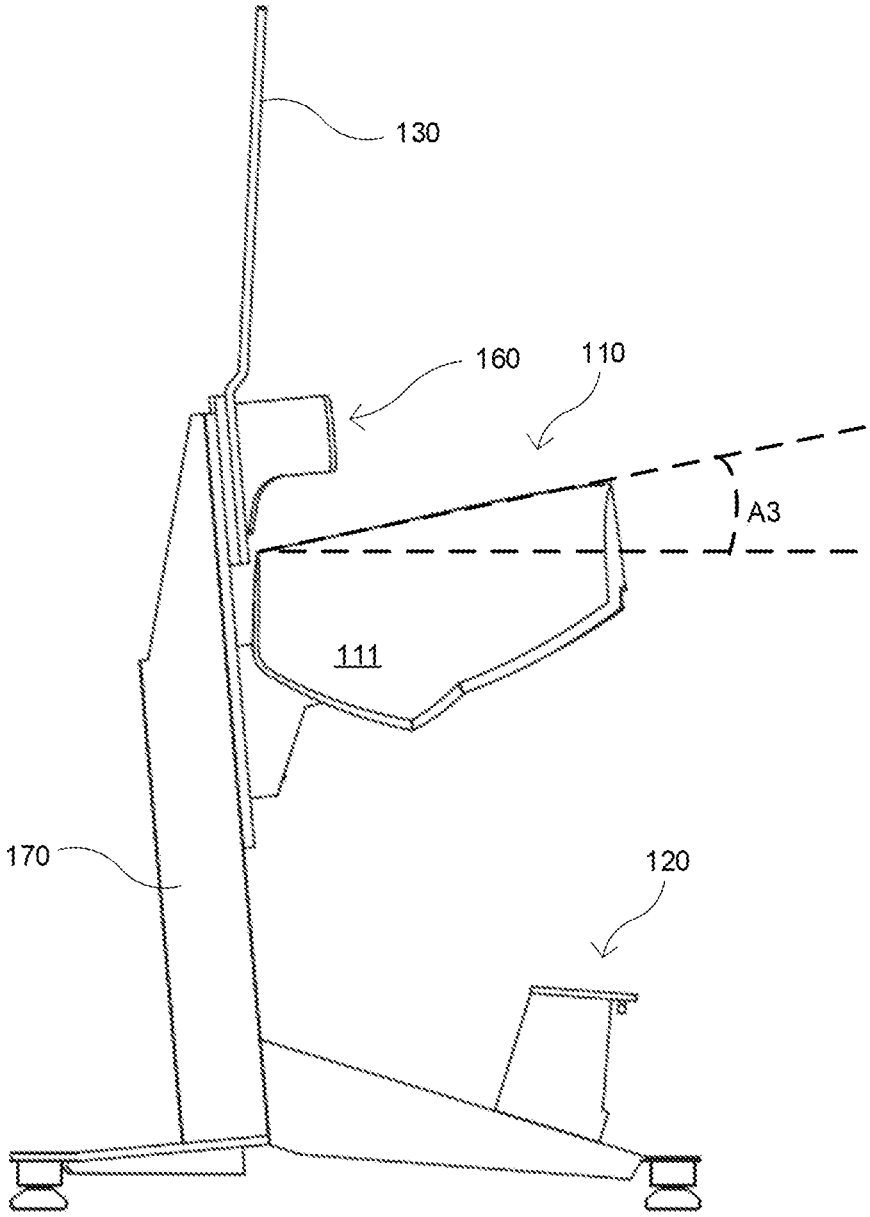

In the following, the invention will be described in detail, with reference to exemplifying embodiments of the invention and to the enclosed drawings, wherein:

FIG. 1*a* is a schematic side view of an ergonomic chair according to an exemplifying embodiment;

FIG. 1*b* shows the ergonomic chair of FIG. 1*a* with a person sitting thereon;

FIG. 1*c* shows the ergonomic chair and person shown in FIG. 1*b* and also with certain angles according to the present invention;

FIG. 2*a* is a perspective view of an ergonomic chair according to an exemplifying embodiment;

FIG. 2*b* is a side view of the ergonomic chair of FIG. 2*a;*

Figure 2C:
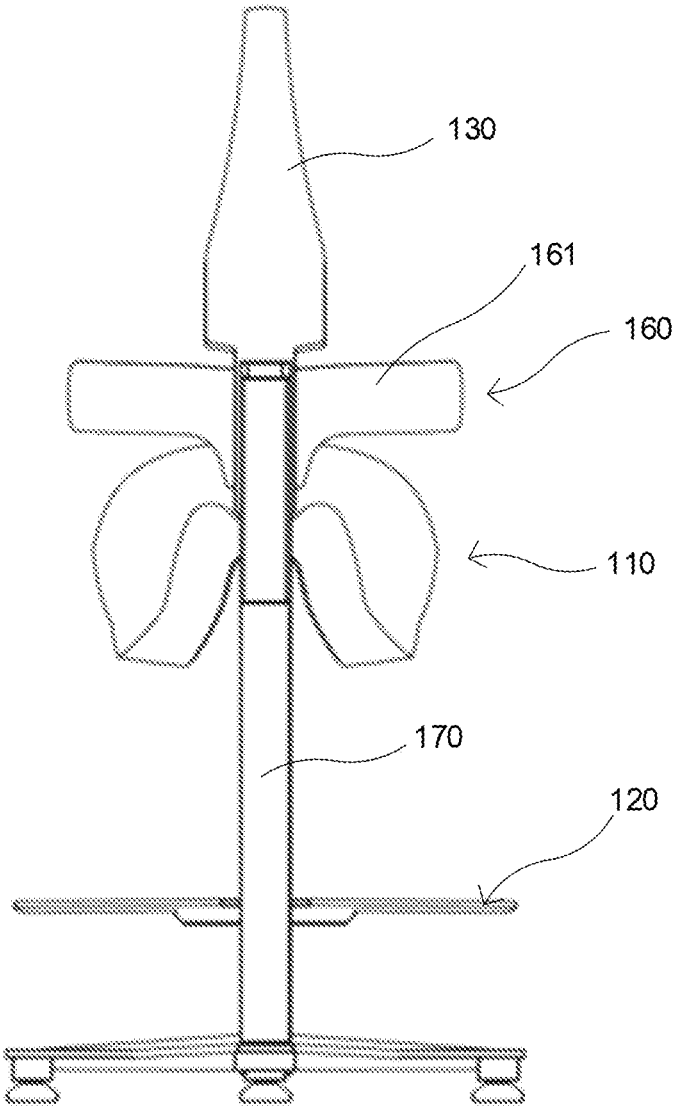

FIG. 2*c* is a front view of the ergonomic chair of FIG. 2*a;*

Figure 2D:
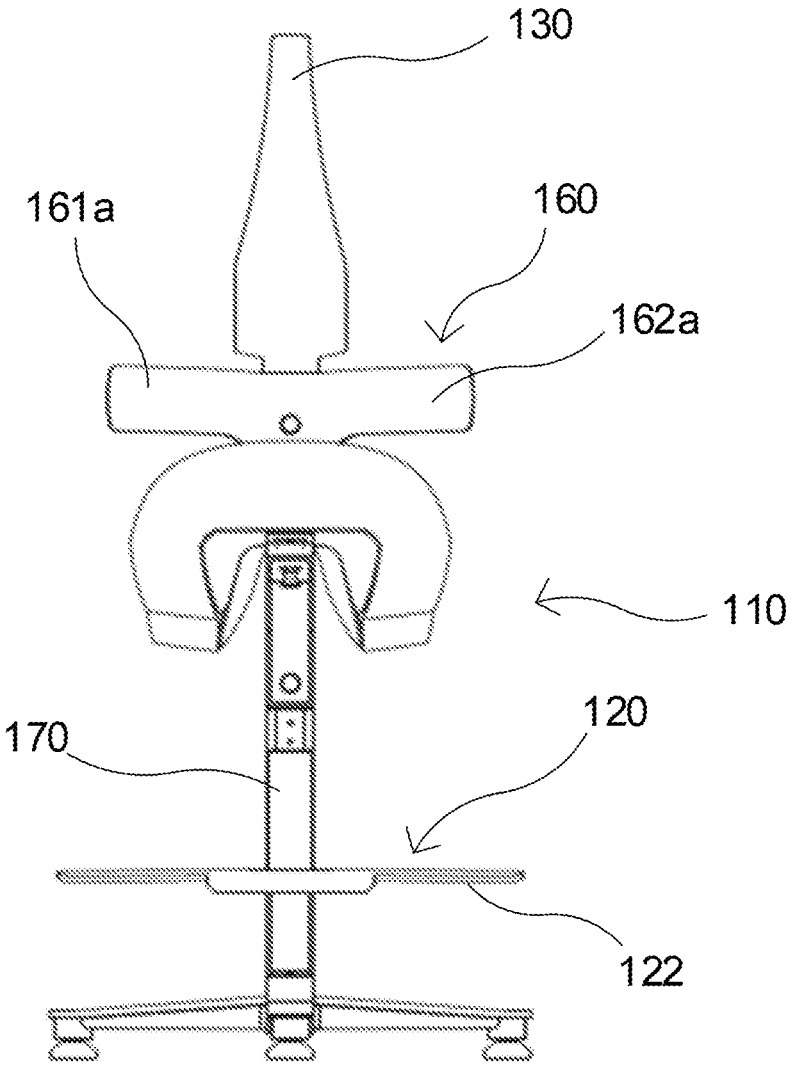

FIG. 2*d* is rear view of the ergonomic chair of FIG. 2*a;*

Figure 2E:
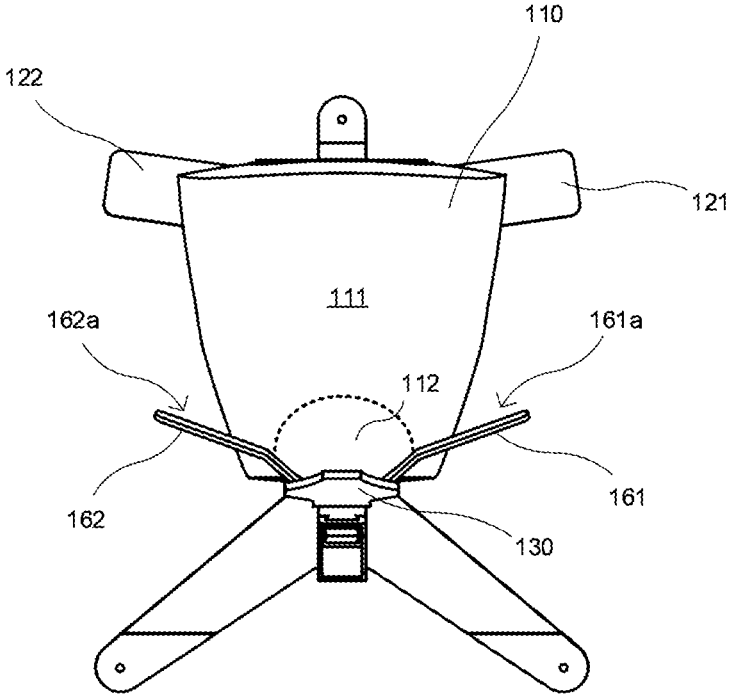

FIG. 2*e* is a view from above of the of the ergonomic chair of FIG. 2*a;*

Figure 3:
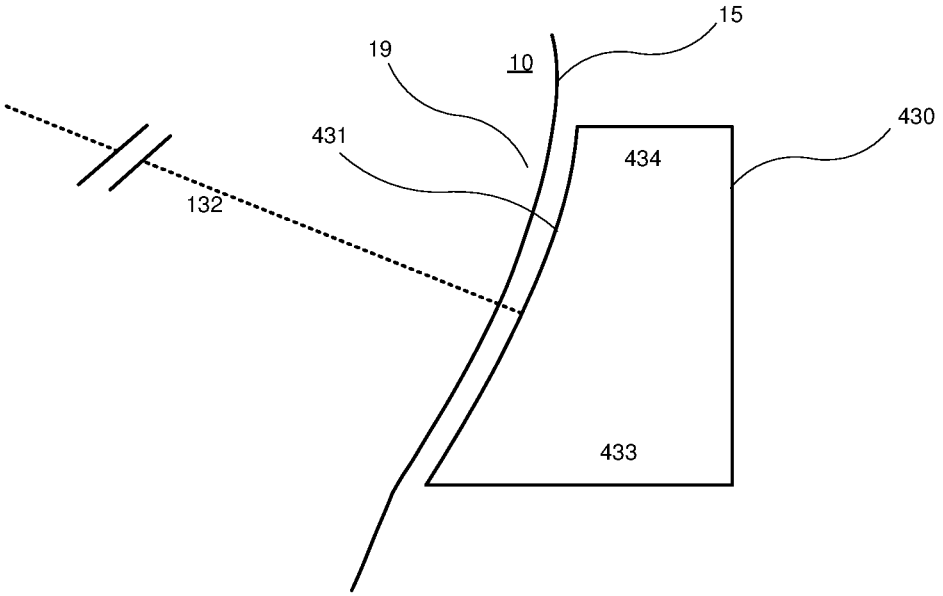

FIG. 3 illustrates, in more detail, an exemplifying chest support, corresponding to chest supports illustrated in FIGS. 1*a*-1*c*, 2*a*-2*e*.

In all the Figures, the same last two digits in each reference numeral are used to denote the same or corresponding details. The Figures are not necessarily drawn to scale.

s FIGS. 1*a* and 2*a*-2*e* illustrates, in respective views, exemplifying embodiments of a piece of ergonomic chair 100, 300 according to the present invention. The piece of ergonomic chair 100, 300 comprises a seat 110, 310, a lower leg support 120, 320, a chest support 130, 330, and a hip support 160, 360.

In the following the function will be described in relation to FIGS. 1*a* and 1*b* which shows a seated person on the chair 300. Corresponding parts of FIG. 2*a*-2*e* are also added to the discussions relating to FIGS. 1*b* and 1*c*. FIG. 1*b* illustrate the ergonomic chair 100, 300 with a seated user 10. In the Figure, the user 10 is illustrated in a seated position, in which the user sits in an ergonomically favourable position made possible by the specific geometric constitution of the piece of ergonomic chair 100, 300 in question, as will be explained in the following.

In particular, the seat 110, 310 is arranged to support the posterior thigh 11 and/or the buttocks 12 of the seated user 10 and is configured to urge the hip of a seated user 10 in a forward direction towards the hip support 160, 360, which hip support 160, 360 is configured to support the anterior hip of a seated user 10, such that the femur bone 13 of the seated user 10 is downwards inclined in the anterior direction at an angle A1 of at least 40° C., more preferably at least 50°, and at the most 75°, more preferably at the most 65°, in relation to the horizontal. This is best illustrated in FIG. 1*c* in which the various angles described herein are illustrated. This femur bone position and inclination may, for instance, be achieved by the seat 110, 310 being inclined as described below and the relative geometric arrangement between the seat 110, 310, the lower leg support 120, 320, the chest support 130, 330 and/or hip support 160, 360.

Furthermore, the lower leg support 120, 320 is arranged to support the anterior side of the lower legs 14 of the seated user 10, whereas the chest support 130, 330 is arranged to support the chest 15 of the seated user 10 in a forward leaning position of the user 10 illustrated in FIGS. 1*b*, 1*c*. This forward leaning position results from the user 10 sitting down onto the piece of ergonomic chair 100, 300, as a consequence of the combined geometry of the seat 110, 310, the lower leg support 120, 320, the chest support 130, 330 and the hip support 160, 360 in relation one to the other. Hence, the piece of ergonomic chair 100, 300 is arranged to encourage or even force the user 10 to assume said forward leaning position when seated in the piece of ergonomic chair 100, 300 by the relative geometric arrangement of its constituent parts.

The seat 110, 310, the lower leg support 120, 320 and the chest support 130, 330 may optionally be fixedly arranged in relation to each other, such as via metal bars or in any other suitable manner. In other words, the support points could then fixedly arranged one in relation to the other in space. However, the hip support 160, 360 is preferably upward and downward movable such that it can be set to be at level on top of the anterior thigh of a seated user 10. The hip support 160, 360 can preferably be secured at different vertical positions.

It is desirable that the seated user 10, when in said forward leaning position, is oriented such that the third lumbar vertebrae body 16 of the seated user 10 is arranged in a support plane 350 illustrated in FIG. 1*c*, which support plane 350 is perpendicular to the sagittal plane of the seated user 10. Hence, the support plane 350 is perpendicular to the paper in FIG. 1*c*.

Furthermore, the respective pivot point 17 of the seated user's 10 hip joints and the respective pivot point 18 of the seated user's 10 shoulder joints are also arranged in the said support plane 350 when the posture of the seated user 10 is symmetric about the sagittal plane of the seated user 10 in the forward leaning position. This property of the forward leaning position is achieved by a combination of the position and angle of the seated user's 10 femur bone 13 and the location of the chest support 130, 330 point.

It is understood that in FIG. 1*c* the sagittal plane of the seated user 10 is parallel to the paper, resulting in that the said pivot points 17, 18 are both located on top of each other in FIG. 1*c*. However, according to the present invention, both the two hip joint pivot points 17, both the two shoulder joint pivot points 18 and the body of the third lumbar vertebrae are arranged in said support plane 350 when the seated user 10 is positioned in said forward leaning position supported by the piece of ergonomic chair 100, 300.

The present inventors have discovered that a piece of ergonomic chair which, due to its relative geometric positioning of the different support structures 110, 120, 130, 160, 310, 320, 330, 360 results in a seated user 10 assuming the above described position, with the support plane 350 in which the said anatomic details 16, 17, 18 are located, provides an ergonomically very advantageous sitting experience. The seated user 10 can relax fully while maintaining very low levels of destructive tension and at the same time keeping an active position in turn resulting in increased attention on the task at hand.

In particular, it is preferred for ergonomic reasons that the forward leaning position is such that the femur bone 13 of the seated user 10 is downwards inclined in the user's anterior direction, at an angle A1 of at least 40° C., more preferably at least 50°, and at the most 75°, more preferably at the most 65° in relation to the horizontal.

In an ergonomically preferred embodiment, the said support plane 350 is inclined at an angle A2 of at least 65°, preferably at least 70°, and at the most 90°, in relation to the horizontal. The angle A2 could be in the range 75-90° but also be in the range 80-90°. The angle A2 may also be at most 85°.

Furthermore, the present inventors have discovered that the above described positive ergonomic effects are achieved more efficiently in the preferred case in which the piece of ergonomic chair 10 does not include a head support. This is illustrated in FIG. 1*c*, in which the ergonomic chair 100, 300 does not include a head support. Such head supports may, for instance, be neck, jaw, temple or forehead supports. Preferably, the head of the seated user 10 is completely unsupported, so that the seated user 10 is required to balance his or her head completely on his or her own. Given the orientation of the seated user 10 in the above described support plane 350, the balancing of the head will in general then result in the user orienting his or her head so that the gaze of the seated user 10 is oriented horizontally, in turn yielding an ergonomically favourable seating position of the user 10 provided the forward leaning position described herein.

The seat 110, 310 preferably has a forward downward inclined seating surface 111, 311, to urge the hip of a seated user 10 in a forward direction.

1° The angle A3 determines the angle of the seating surface 111, 311 ultimately supporting the buttocks 12 or posterior thigh 11 of the seated user 10, and therefore also impacts the position of the seated user 10, such as the femur bone 13, in said forward leaning position.

In particular, it is preferred that the seating surface 111, 311, as the case may be, is inclined forwards and downwards (in relation to the seated user 10) at the angle A3 of between 1° and 20° to the horizontal, preferably 1-15°, more preferably, 3-12°.

In one example the seating surface 111, 311 has no inclination to the horizontal.

In general, in the forward leaning position, it is preferred that the majority of the seated user's 10 weight is supported by the seat 110, 310, as opposed to by the lower leg support 120, 320 or the chest support 130, 330. This is achieved by the relative geometric arrangements between these parts, as described herein and as exemplified in the Figures.

Preferably, the ergonomic chair 100, 300 does not comprise any other seated user 10 load-supporting details, apart from the seat 110, 310; the lower leg support 120, 320; the chest support 130, 330, and the hip support 160, 360 that are in use for supporting the seated user 10 in said forward leaning position.

Regarding the lower leg support 120,320, it is preferred that this part is arranged in such a way so that the lower legs 14 of the seated user 10 are oriented substantially horizontally, further preferably so that the tibia 20 of the seated user 10 is inclined at a non-zero angle A4 upwards from the user's 10 knee and backwards in the forward leaning position, in relation to the horizontal, which angle A4 may preferably be between 0° and 10° upwards from the user's 10 knee in relation to the horizontal.

Furthermore, the ergonomic chair 100, 300 may further comprise arm rests 340, arranged to support the elbows or lower arms of the seated user 10, when in said forward leaning position, at a height and in a position of the seated user 10 in which the seated user's 10 shoulders are relaxed. Preferably, the upper arms of the seated user 10 may then be vertical or slightly forward downwards inclined. The lower arms of the seated user 10 are then preferably substantially horizontally arranged. In this position, operation of a keyboard, a computer mouse or similar is possible in an ergonomically sound way.

As an alternative to arm rests a desktop surface may be integrated to the frame 170 of the chair 100;300, said desktop surface in front of and above the hip support 160, 360.

Regarding the hip support 160, 360. As seen in the example of FIG. 2*a*-2*e* the hip support 160 has a support area 161*a*, 162*a* on each lateral side of the chair 100. These are intended for supporting the anterior hip of a seated user, in particular the anterior superior iliac spines thereof. Thereby the seated user's anterior hip can be supported by the support areas 161*a*, 162*a* as the seat 110 urges the seated user's hip forwardly. The support areas 161*a*, 162*a* are located on a respective hip support arm 161,162, which each extends laterally on a respective side of the chair 100 and at a vertical position above the seat 110. As already mentioned, the hip support 160;360 is preferably upward and downward movable such that it can be set to be at level on top of the anterior thigh of a seated user. Thereby securing the desired position outlined in relation to FIGS. 3*b* and 3*c*.

Furthermore, regarding the hip support 160, 360, as is illustrated using double-sided arrows in FIG. 2*a*, in some embodiments the hip support arms 161, 162 are vertically displaceable, such as foldable or movable upwards/downwards. For instance, the hip support arms 161, 162 may be joined to the frame 170 using a pivot joint or a vertically movable joint, such as using a block in a vertical guide track. Hence, in order to enter the chair, the user may lift/pivot the hip support arms 161, 162 upwards, sit down on the seating surface 111, 311 and again lower the hip support arms 161, 162 down onto the legs of the user so as to assume the said seated position. It is understood that the support areas 161*a*, 162*a* then also move upwards/downwards with the hip support arms 161, 162. It is preferred that the hip support arms 161, 162 are arranged not be locked in a lowered position, so that they can move/pivot upwards/downwards freely when the user is seated in the seated position. Namely, it has turned out that such movable hip support arms 161, 162 provide for a more ergonomic sitting experience when sitting during prolonged time periods, since they allow the user to fine-tune the sitting position and to move around in the chair to some extent.

Regarding the leg support 120, 320. As seen in the example of FIG. 2*a*-2*e* the leg support 120 may comprise a laterally extending arm section 121, 122 on each side of the chair. Optionally, the laterally extending arm sections 121, 122 of the leg support can be folded in, such that the arm sections 121, 122 extend along a central longitudinal line of the seating furniture to enable a seated user to use the chair without using the leg support. Optionally the leg support 120 can be movable back and forward along a central longitudinal line to adjust its position.

Furthermore regarding the leg support 120, 320, and as is also illustrated using double-sided arrows in FIG. 2*a*, in some embodiments the arm section 121, 122 may be pivotable or rotatable in the horizontal plane between said lateral and said longitudinal orientations. Preferably, this pivoting or rotation is unrestrained, so that the seated user can swing his or her legs, that rest on the sections 121, 122, back and forth by rotating the leg support 120, 320 in the horizontal plane. This has turned out to be very advantageous from an ergonomic point of view, since this allows the user to move without loosing the ergonomically correct position automatically defined by the different parts of the chair as described herein.

In a particularly preferred embodiment, both the hip support arms 161, 162 and the leg support sections 121, 122 are freely movable as described above. This provides relatively free movement of the seated user without loosing the ergonomically advantageous sitting position provided by the present chair.

Regarding the seat 110, 310. As seen in the example of FIG. 2*a*-2*e*, the seat 110 is wider at a rear end of the seat 110 than at a forward end of the seat 110. Furthermore, the width of the seat 110 gradually becomes narrower from the rear end of the seat 110 towards the forward end of the seat 110. The seat 110 has an arcuated longitudinal cross-section with smaller and smaller arches in the forward direction, thereby providing a saddle like shape of the seat 110; 310. The shape of the seat 110 contributes in urging the hip of a seated user in a forward direction.

The seat 110 has an area 112 in the forward end of the seat 110 that has a softer cushioning than the rest of the seat 110 in order to provide less pressure to the private parts of a male user of the seat 110. The softer cushioning can e.g. be provided by a volume of less firm material at the forward end of the seat 110, or e.g. by an inner void at a forward end of the seat 110. As an alternative, the seat 110 may have a recess at the forward end of the seat 110 in order to provide less pressure to the private parts of a male user of the seat 110. Such softer cushioning or void can be arranged only at a front end of the seat, or also extend backwards along a centerline of the seat 110, such as at least 10 cm backwards, or at least 20 cm backwards, or even along the full longitudinal length of the seat 110. For instance, the seat 110 may form a cross-sectional shape similar to the letter "M" in a series of vertical cross-sections taken at different locations along the seat 110 from a front end of the seat 110 and backwards.

The seat may be provided with cushioning layers, such that it has at least has two cushioning layers on top of each other, an outermost layer closest to the posterior thigh and/or buttocks of a seated user and an innermost layer for attaching to a frame of the chair 100, each layer having a different firmness as measured by indentation load deflection.

The layers are preferably arranged to have higher firmness at the innermost layer of the seat and decreasing firmness of each layer towards the outermost layer. Preferably, at least one of the layers includes a solid foam, preferably a polymeric foam. All layers can be solid foams of different firmness, in particular polymeric foams. In one embodiment the number of foam layers are three.

s FIG. 3 illustrates, in more detail, an exemplifying chest support 430, corresponding to chest supports 130, 330 illustrated in FIGS. 1*a*-1*c*, 2*a*-2*e*. According to the invention, the chest support 430 is associated with (comprises a surface with) a concave shape 431, arranged to be complementary to a corresponding convex shape of the seated user's 10 chest 15, and in particular to the convex shape of the seated user's 10 chest 15 when the seated user 10 in question is oriented along said support plane 450 as described above, in the forward leaning position. Such a concave shape 431, in combination with the orientation of the above-described supporting parts 110, 120, 130; 310, 320, 330 of the ergonomic chair 100, 300, hence encourages, or even forces, the seated user 10 to assume said forward leaning position along the support plane 450 as described above. The concave shape 431 may be a developable or a non-developable surface.

In particular, the said concave shape 431 comprises a concave curvature, in a vertical cross-sectional plane which preferably is the seated user's sagittal plane, which concave curvature has a radius of curvature 432 of between 2 and 3 meters.

As is illustrated in FIG. 2*a*, the chair 100 preferably has three contact points or feet 171*a*, 171*b*, 171*c*. The chair 100 may also have four such contact points, even if it is preferred that there are three contact points. Furthermore, two of these contact points 171*a*, 171*b* are advantageously arranged to contact a floor on which the chair 100 stands at two different contact points arranged in front of a centre of mass of the chair 100, and preferably also in front of a centre of mass of the seated user. If there are three contact points, the third one 171*c* may then be arranged behind the first two contact points 171*a*, 171*b*, behind said centres of mass.

Moreover, the chair may comprise a base structure, in FIG. 2*a* illustrated as three arms 172 extending from a common point to each of said feet 171*a*, 171*b*, 171*c*. Alternatively, the base structure may comprise a horizontal plate. The rest of the frame 170 may then connect to said common point, in FIG. 2*a* illustrated by a substantially vertical bar 173 extending upwards from said common point on the base structure.

The base structure, including arms 172, is preferably made from metal or wooden material, providing a certain resilience. The two front floor contact points 171*a*, 171*b* are preferably arranged at least 40 cm apart. In case there are two back floor contact points, they are preferably arranged at the most 20 cm apart from each other. This configuration has proven to provide the user with the possibility to move his or her centre of gravity from side to side to a certain extent, making it possible to sit comfortable for longer periods of time without leaving the ergonomically correct sitting position resulting from the chair 100. In particular this is the case for a chair with three contact points 171*a*, 171*b*, 171*c* as described above. Further particularly, when combining such a base structure with the above discussed movable hip support arms 161, 162 and/or leg support 120, 320, the chair 100 will allow the user to undertake micro movements when sitting in the chair 100 that allow the user to sit comfortably much longer without exiting the ergonomically advantageous sitting position described herein.

Above, preferred embodiments have been described. However, it is apparent to the skilled person that many modifications can be made to the disclosed embodiments without departing from the basic idea of the invention.

In general, all the embodiments described above can be combined in anyway, as applicable.

The ergonomic chair 100, 300 may comprise many other design features apart from the ones described above and illustrated in the Figures, as long as the principles described herein, concerning the forward leaning position of the seated user 10, are respected.

In particular, the ergonomic chair 100, 300 may be adjustable in various ways, so as to be adapted to users 10 of various lengths, weights and other constitutions.

The ergonomic chair 100, 300 may also comprise paddings and other features improving sitting comfort.

Hence, the invention is not limited to the described embodiments, but can be varied within the scope of the enclosed claims.

The invention claimed is:

1. An ergonomic chair (100;300) comprising a seat (110; 310), a lower leg support (120;320), a chest support (130; 330), and a hip support (160;360);

the seat (110;310) for supporting the posterior thigh (11) and/or buttocks (12) of a seated user (10), the seat (110, 310) being configured to urge the hip of a seated user (10) in a forward direction;

the lower leg support (120;320) for supporting the anterior side of the lower legs (14) of the seated user (10);

the chest support (130;330; 430) for supporting the chest (15) of the seated user (10) in a forward leaning position of the seated user (10); and the hip support (160;360) is configured to support the anterior hip of a seated user (10) as the seat (110;310) urges the seated user's (10) hip forwardly towards the hip support (160;360);

wherein the seat has an area (112) in the forward end of the seat (110; 310) that has a softer cushioning than the rest of the seat (110;310) in order to provide less pressure to the private parts of a male user (10) of the seat (110; 310), or the seat has a recess at the forward end (110*a*) in order to provide less pressure to the private parts of a male user (10) of the seat (110; 310).

2. The chair (100;300) according claim 1, wherein the hip support (160;360) having a support area (161*a*, 162*a*) on each lateral side of the chair for supporting the anterior hip of a seated user (10), in particular the anterior superior iliac spines thereof, thereby the seated user's (10) anterior hip can be supported by the support areas (161, 162) as the seat (110;310) urges the seated user's (10) hip forwardly.

3. The chair (100;300) according claim 2, wherein the support areas (161*a*, 162*a*) are located on a respective hip support arm (161,162) extending laterally on a respective side of the chair (100, 300) and at a vertical position above the seat (110;310).

4. The chair (100;300) according to claim 1, wherein, the seat (110;310) has a forward downward inclined seating surface (111;311), to urge the hip of a seated user (10) in a forward direction.

5. The chair (100;300) according to claim 4, wherein the forward downward tilted seating surface (111;311) is tilted at an angle (A3) in the range of 1-20° to the horizontal, preferably 1-15°, more preferably, 3-12°.

6. The chair (100;300) according to claim 1, wherein the seat is wider at a rear end (110*b*) of the seat than at a forward end (110*a*) of the seat.

7. The chair (100;300) according to claim 1, wherein the width of the seat gradually becomes narrower from the rear end of the seat towards the forward end of the seat.

8. The chair (100;300) according to claim 1, wherein the seat (110; 310) has an arcuated longitudinal cross-section, preferably with smaller and smaller arches in the forward direction, thereby providing a saddle like shape of the seat (110; 310) urging the hip of a seated user (10) in a forward direction.

9. The chair (100;300) according to claim 1, wherein the softer cushioning is provided by a volume of less firm material at the forward end of the seat (110; 310).

10. The chair (100;300) according to claim 1, wherein the softer cushioning is provided by an inner void at a forward end of the seat (110; 310).

11. The chair (100;300) according claim 1, wherein the seat is layered such that it at least has two cushioning layers on top of each other, an outermost layer closest to the posterior thigh (11) and/or buttocks (12) of a seated user (10) and an innermost layer for attaching to a frame (170) of the chair (100; 300), each layer having a different firmness.

12. The chair (100;300) according to claim 11, wherein the layers are arranged to have higher firmness at the innermost layer of the seat and decreasing firmness of each layer towards the outermost layer.

13. The chair (100;300) according to claim 1, wherein the leg support (120;320) comprising a laterally extending arm section (121, 122) extending laterally on each side of the chair.

14. The chair (100;300) according to claim 1, wherein the hip support (160; 360) is configured to support the anterior hip of a seated user (10), such that the femur bone (13) of the seated user (10) is downwards inclined in the anterior direction of the seated user (10) at an angle of between 40° C.-75° in relation to the horizontal.

15. The chair (100;300) according to claim 1, wherein a forward leaning position is achieved by a combination of the position and angle of the seated user's (10) femur bone (13) and the location of the chest support (130, 330) point, said forward leaning position, is oriented such that the third lumbar vertebrae body (16) of the seated user (10) is arranged in a support plane (350), and the respective pivot point (17) of the seated user's (10) hip joints and the respective pivot point (18) of the seated user's (10) shoulder joints are also arranged in the said support plane 350 when the posture of the seated user 10 is symmetric about the sagittal plane of the seated user 10 in the forward leaning position, which support plane (350) is perpendicular to the sagittal plane of the seated user (10), the support plane (350) is inclined 75-90°, in relation to the horizontal.

16. The chair (100;300) according to claim 1, wherein the chest support (430) comprises a concave shape (431) arranged to be complementary to a corresponding convex shape of the seated user's chest (15).

17. The chair (100;300) according to claim 16, wherein the said concave shape (431) comprises a concave curvature in a vertical cross-sectional plane.

18. The chair (100;300) according to claim 17, wherein said concave curvature in said vertical cross-sectional plane has a radius of curvature (432) of between 2 and 3 meters.

19. The chair (100;300) according to claim 1, wherein the lower leg support (120; 320) is arranged such that the lower legs (14) of the seated user (10) are oriented substantially horizontally, preferably so that the tibia (20) of the seated user (10) is inclined between 0° and 10° upwards from the knee of the seated user (10), in relation to the horizontal.

* * * * *